US006800990B2

(12) United States Patent
Choi et al.

(10) Patent No.: US 6,800,990 B2
(45) Date of Patent: Oct. 5, 2004

(54) CATHODE MATERIAL INCLUDING RARE EARTH METAL USED AS ELECTRON EMISSION SOURCE FOR ELECTRON BEAM APPARATUS

(75) Inventors: Jong-Seo Choi, Suwon (KR); Hyek-Bok Lee, Suwon (KR); Kyu-Nam Joo, Suwon (KR); Yoon-Chang Kim, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 606 days.

(21) Appl. No.: 09/756,865

(22) Filed: Jan. 10, 2001

(65) Prior Publication Data

US 2001/0009348 A1 Jul. 26, 2001

(30) Foreign Application Priority Data

Jan. 10, 2000 (KR) ..... 2000/963

(51) Int. Cl.[7] ..... H01J 19/06
(52) U.S. Cl. ..... 313/346 R; 313/346 DC
(58) Field of Search ..... 313/346 R, 346 DC, 313/446, 447, 337, 441; 445/51

(56) References Cited

U.S. PATENT DOCUMENTS

| | | | | |
|---|---|---|---|---|
| 3,436,584 A | 4/1969 | Hughes et al. | ..... | 313/346 |
| 5,072,149 A | 12/1991 | Lee et al. | ..... | 313/346 R |
| 5,519,280 A | 5/1996 | Shon et al. | ..... | 313/346 R |
| 5,580,291 A | 12/1996 | Redel et al. | ..... | 445/28 |
| 5,808,404 A | 9/1998 | Koizumi et al. | ..... | 313/346 R |
| 5,828,165 A | 10/1998 | Clerc et al. | ..... | 313/346 R |
| 5,977,699 A | 11/1999 | Joo et al. | ..... | 313/346 |
| 5,982,083 A | 11/1999 | Ju et al. | ..... | 313/346 R |
| 6,124,666 A | 9/2000 | Saito et al. | ..... | 313/346 R |

FOREIGN PATENT DOCUMENTS

| | | |
|---|---|---|
| RU | 2052855 | 4/1993 |
| SU | 616662 | 7/1978 |
| WO | WO 00/21110 | 4/2000 |

OTHER PUBLICATIONS

S.E. Rozhkov et al, *Work function of the alloy of Iridium with Lanthanium, Cerium, Praseodymium, Neodymium, Samarium*, Journ. Radiotechnika 1 electronics, 1969, v.14, No. 5, p936–analogue, no month.

*Primary Examiner*—Joseph Williams
(74) *Attorney, Agent, or Firm*—Robert E. Bushnell, Esq.

(57) ABSTRACT

The present invention provides a cathode material for an electron beam device. The cathode material is characterized by the fact that it includes 0.5–9.0% by weight of a rare earth metal of the cerium group, 0.5–15.0% by weight of tungsten or rhenium or both tungsten and rhenium, 0.5–10% by weight of carbon and the remainder of iridium. The cathode material according to the invention has excellent plasticity, can be easily used for manufacturing an emitter of a small size, has high electron emission power, and has a low operation temperature, thereby having a long lifetime, and it is therefore useful for a cathode material for an electron beam device.

14 Claims, 3 Drawing Sheets

CATHODE MATERIAL INCLUDING RARE EARTH METAL USED AS ELECTRON EMISSION SOURCE FOR ELECTRON BEAM APPARATUS

CLAIM OF PRIORITY

This application makes reference to, incorporates the same herein, and claims all benefits accruing under 35 U.S.C. § 119 from an application entitled Cathode Material for Electron Beam Device earlier filed in the Korean Industrial Property Office on Jan. 10, 2000, and there duly assigned Serial No. 963/2000 by that Office.

BACKGROUND OF THE INVENTION

1. Field of the Invention

The present invention relates to a cathode material for an electron beam apparatus, and more particularly, to a cathode material used as an electron emission source of a vacuum electron beam apparatus such as a cathode-ray tube.

2. Description of the Background Art

Cathode systems in use today are based mainly on electron emission systems where electrons are emitted by an oxide cathode heated indirectly by a filament. However, these systems have difficulty in emitting more than 1 A/cm$^2$ (amperes per square centimeter) of current density, due to a limitation of electron emission power.

Also, the oxide cathode is fragile and has low adhesive strength to metal materials loaded, and thus the cathode apparatus with this type of the cathode has a short lifetime. For example, even if only one of the three oxide cathodes of the color Braun tube is damaged, the total apparatus, which is costly, will be out of order.

Owing to these reasons, there have been active attempts to apply to the cathode-ray apparatus highly efficient metal cathodes that are free of the disadvantages of the oxide cathodes described above.

For instance, a metal cathode based on lanthanum hexaboride($LaB_6$) is known to have a higher degree of strength and electron emission power compared to oxide cathodes, and a single crystal cathode can emit a higher electron current density on the order of 10 A/cm$^2$. However, the lanthanum hexaboride cathode has a short lifetime, and thus it has been used only partially in a vacuum electronic apparatus whose cathode unit can be replaced. The reason that the lanthanum hexaboride cathode has a short lifetime is due to high reactivity with the components of a heater, and to the fact that lanthanum hexaboride is in contact with the components of the heater, e.g. tungsten, to form fragile compounds.

U.S. Pat. No. 4,137,476, issued to Ishii, et al., for Thermionic Cathode discloses a cathode where a barrier between lanthanum hexaboride and the body of the heater is formed, in order to eliminate the reaction possibility. But, according to this method, the production cost of the cathode increases significantly and it is difficult to improve the lifetime of the cathode.

Also, as a material with a high electron emission specific density, an alloy including iridium and a small amount of a rare earth metal of the cerium group lanthanum, cerium, praseodymium, neodymium, samarium), (S. E. Rozhkov et. al, *Work function of the alloy of Iridium with Lanthanium, Cerium, Praseodymium, Neodymium, Samarium,* Journ. Radiotechnika I electronica, 1969, v.14, No.5, p936-analogue) has been known.

However, this alloy has the property that the speed of the active components to migrate to the cathode surface decreases with operation of the cathode, so that as time goes by, the work function increases rapidly and the electron emission property and the resistance of the cathode to ion impact decrease. The binary alloy is fragile and thus the cathode unit is not easy to manufacture and not operable at high temperature due to its low melting point. Therefore the alloy is not suitable for applying to an electronic apparatus requiring a long lifetime and operation stability.

SU (Soviet Union) Patent No. 616662 discloses a cathode material of a trinary alloy of iridium, cerium and hafnium. The cathode material has excellent emission stability and plasticity, but its melting point is low and thus it is not applicable to an electronic apparatus requiring operation at high temperature.

Russian Federation Patent No. 2052855 discloses as a cathode material of an alloy of iridium, lanthanum or cerium, tungsten, and rhenium. In this patent, the cathode lifetime has been increased by including in the alloy tungsten or rhenium, but the latter two metals are fragile, and thus the cathode including them is also fragile and the electron emission power decreases.

Further exemplars of the art are U.S. Pat. No. 5,519,280 issued to Shon et al for Oxide Cathode, U.S. Pat. No. 6,124,666 issued to Saito et al. for Electron Tube Cathode, U.S. Pat. No. 3,436,584 issued to Hughes et al. for Electron Emission Source with Sharply Defined Emitting Area, U.S. Pat. No. 5,982,083 issued to Ju et al. for Cathode for Electron Tube, U.S. Pat. No. 5,072,149 issued to Lee et al. for Cathode for Electron Gun and its Manufacturing Method, U.S. Pat. No. 5,580,291 issued to Redel et al. for Method for Manufacturing a Glow Cathode for an Electron Tube, U.S. Pat. No. 5,977,699 issued to Joo et al. for Cathode for Electron Tube, U.S. Pat. No. 5,808,404 issued to Koizumi et al. for Electron Tube Including a Cathode Having an Electron Emissive Material Layer, U.S. Pat. No. 5,828,165 issued to Clerc et al. for Thermionic Cathode for Electron Tubes and Method for the Manufacture Thereof, and W.O. Patent No. 00/21110 to Choi et al. for Cathode Material of Electron Beam Device and Preparation Method Thereof.

SUMMARY OF THE INVENTION

It is therefore an object to provide a cathode material with an improved lifetime and mechanical properties for an electron beam apparatus as well as excellent electron emission power.

It is another object to have a cathode material that has low reactivity with the components of the heater.

It is yet another object to have a cathode material used for an electron beam device that is not highly fragile and has higher adhesive strength.

It is still yet another object to have a cathode material that has an improved lifetime and increased emission power while not increasing production cost and still having ease of manufacture.

In order to achieve the above objectives, the invention provides a cathode material having between 0.5 to 9.0% by weight of a rare earth metal of the cerium group, between 0.5 to 15% by weight of tungsten or rhenium or both tungsten and rhenium, between 0.5–10% by weight of carbon and the remainder of iridium. When not mentioned explicitly, the percentage is based on the total weight of the cathode material.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
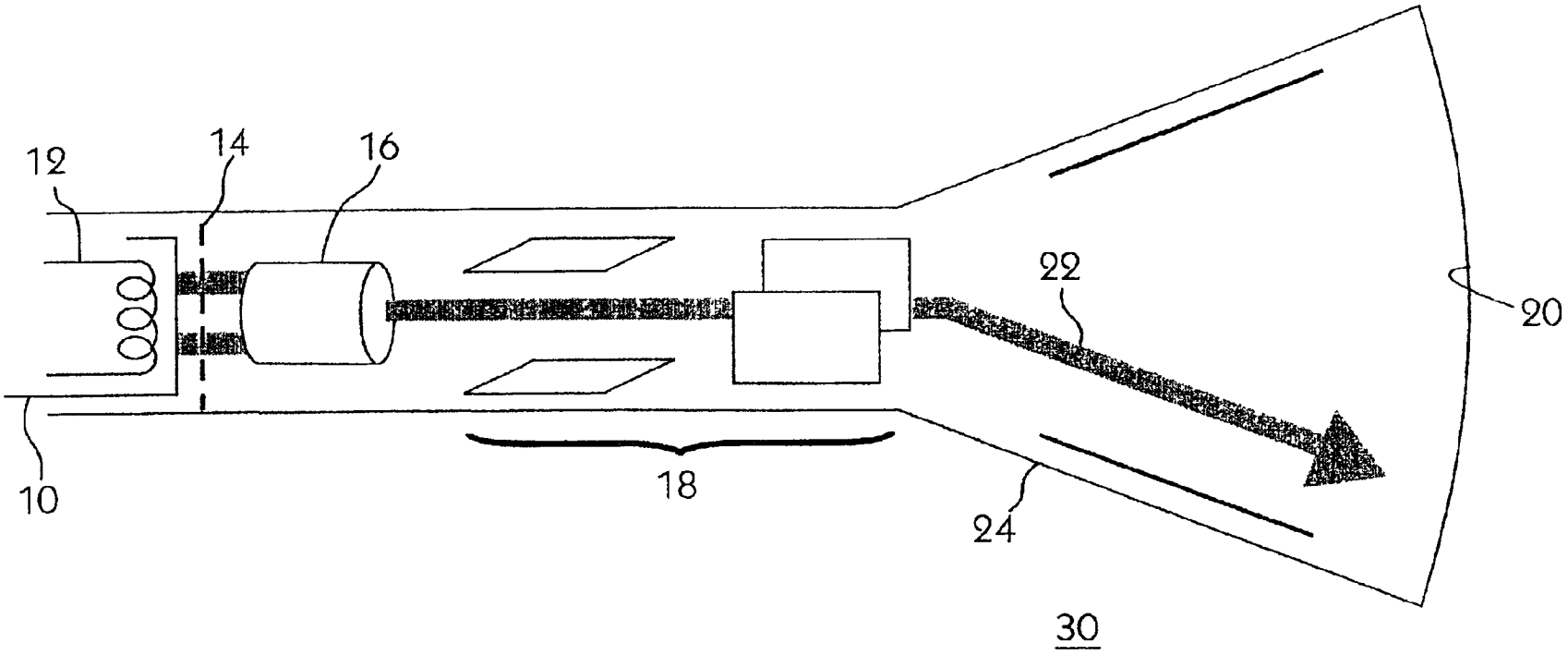
FIG. 1 shows the cathode material used as an electron emission source of a vacuum electron beam apparatus such as a cathode-ray tube.

A cathode material of the present invention improves the electron emission characteristics and the mechanical properties at the same time, by introducing a prescribed amount of carbon, and tungsten or rhenium or both tungsten and rhenium into a cathode material of iridium and a rare earth metal of the cerium group. In other words, in the alloy cathode material of the present invention, carbon plays a role of increasing the plasticity of the alloy as well as decreasing the work function by maintaining high electron emission power at a low temperature of electron emission. Accordingly, an emitter can be easily manufactured from the alloy of the invention containing carbon, and be combined without difficulty to a heater. Meanwhile, the introduction of tungsten or rhenium can make the melting point of the alloy high.

Rare-earth metals are a group of trivalent metallic elements that occur together. The rare-earth metals include elements with atomic numbers 57 through 71, from lanthanum to lutetium, and yttrium, element 39, and scandium, element 21. The cerium metals are a group of rare-earth metals including elements with atomic numbers 57 through 63, including the metal cerium. This group is also called "light rare earths." The metal ytterbium (atomic number 70) may also b included in this group because of its light weight.

The cathode of the invention includes between 0.5 to 9.0% by weight of a rare earth metal of the cerium group. If the amount of the rare earth metal of the cerium group is less than 0.5% by weight, then the lifetime of the cathode shortens due to the lack of the rare earth metal of the cerium group that is an active component, and if it is more than 9.0 % by weight, then there is a problem of forming on the cathode surface compounds such as $Ir_2Ce$ or $Ir_2La$ whose electron emission characteristics is low. Here the rare earth metal of the cerium group is preferably one or more selected from the group including lanthanum (atomic number 57), cerium (atomic number 58), praseodymium (atomic number 59), neodymium (atomic number 60) and samarium (atomic number 62).

The cathode alloy of the invention includes between 0.5 and 15.0% by weight of tungsten or rhenium or both tungsten and rhenium. The amount of tungsten or rhenium or both tungsten and rhenium is selected within the limit to avoid decreasing the plasticity and the electron emission power of the alloy, and if the amount is less than 0.5% by weight, the melting point of the alloy decreases, thereby making it difficult to operate at high temperature, and if the amount is more than 15.0% by weight, there is the problem of decreasing the electron emission power and the plasticity of the cathode. Also, the cathode alloy of the invention includes between 0.5 to 10% by weight of carbon.

The introduction of carbon in the amount according to the invention into the trinary alloy including the rare earth metal of the cerium group, iridium, and tungsten or rhenium or both tungsten and rhenium can improve both the electron emission properties and the mechanical and thus the effect of lifetime improvement is insignificant and the brittleness of the alloy increases. If the carbon content is more than 10% by weight, the electron emission characteristics decline due to the reduction of the relative content of iridium and the melting point of the alloy lowers. The carbon content is preferably between 2 and 5% by weight.

Referring to FIG. 1, the cathode material of the present invention can be used as an electron emission source of a vacuum electron beam apparatus such as a cathode-ray tube for example. The cathode-ray tube 30 includes a cathode 10 emitting electrons when heated by the heating filament 12. The cathode 30 is within a vacuum tube 24. The electron beam from the of emitted electrons are accelerated by a series of annular anodes at progressively higher positive voltages. The anodes may be contained in the focusing system 16 that focuses the electron beam. The electron beam goes through the control grid 14 onto the focusing system 16. The electron beam is then deflected through plates 18 between the gun and a screen. The plates are a part of a deflection system 18. The beam deflection system 18 moves the beam as required to generate an image. The beam of electrons shown by the arrows 22 are focused onto a phosphor-coated display surface 20 of the tube 24 causing the phosphors to emit light.

The alloy according to the invention is described in detail using examples.

Firstly, the gettering before melting of ingot is performed in order to remove impure gases inside a chamber of an argon-arc furnace. Subsequently, iridium and cerium are melted in the chamber. Here, since it is difficult to form compounds between the metals due to the significantly big difference in the specific gravities of iridium and cerium, the reaction of both metals is facilitated by turning the melting body upside down during the heating. The reaction mixture is then sintered by adding carbon in the form of powder. Subsequently, the alloy of cerium and iridium prepared above and the alloy of tungsten and carbon are melted together. Here during the melting process, gettering can be performed 2 to 3 times more. The reason why, as described above, the two binary alloys are prepared first and then melted together, without melting the individual elements together at once, is to improve the chemical and micro structural homogeneity of the alloy according to the invention.

Because the ingot after finishing the process of melting the mixture of the alloy of the present invention may possibly contain residual gases and CeO, after standing up in a slightly tilted way adjacent to the wall of the arc furnace having a round boat-type bottom, the arc electric discharge is performed at a corner of the ingot. During this process, the ingot is melted partially and the melted liquid flows toward the center. At this point, the gases and CeO inside the ingot are removed.

Subsequently, after melting the ingot that the residual gases are removed from again, the ingot is cooled down slowly in order not to produce cracks and the ingot whose electron emission power is improved is manufactured by controlling the crane size of the ingot inside.

The invention is explained in detail with reference to the examples below, and these examples do not limit the scope of the invention.

EXAMPLE 1

First of all, the gettering is in a chamber before melting an ingot was performed. Subsequently, 0.9 g (grams) of cerium was melted in an argon-arc furnace through a tungsten electrode with a current of 120 A (amperes), and then 80.5 g of iridium was melted with the current of 180 A. Here, during heating, the reaction was facilitated by turning the melting body upside down. Then, 0.5 g of tungsten was melted in the arc furnace and the reaction mixture was sintered by adding 10 g of carbon powder. Subsequently, the alloy of cerium and iridium and the alloy of carbon and tungsten prepared above were melted together. Here, during the melting process, the melting body was turned upside down so that the four metals could react well.

The ingot of the four-element alloy of the present invention obtained as described above was stood up in a slightly tilted way adjacent to the wall of the arc furnace having the round boat-type bottom, and then residual gases were removed by melting with the arc electric discharge at a corner of the ingot. After melting the ingot that the residual gases were removed from again, the ingot was cooled down slowly in order not to produce cracks and thereby the four-element alloy of the present invention having 9.0% by weight of cerium, 0.5% by weight of tungsten, 10% by weight of carbon and the remainder of iridium was manufactured.

Subsequently, using the four-element alloy of the present invention, an emitter was manufactured.

EXAMPLE 2

In the same way as in Example 1, except that an alloy of the present invention having as 5.0% by weight of cerium, 10.0% by weight of tungsten, 5.0% by weight of carbon and the remainder of iridium was manufactured using 5.0 g of cerium, 10.0 g of tungsten, 5.0 g of carbon and 80 g of iridium. Subsequently, using the alloy of the present invention, an emitter was manufactured.

EXAMPLE 3

In the same way as in Example 1, except that a four-element-alloy having 6% by weight of cerium, 5% by weight of tungsten, 3% by weight of carbon and the remainder of iridium was manufactured using 6 g of cerium, 5 g of tungsten, 3 g of carbon and 86 g of iridium. Subsequently, using the four-element-alloy, an emitter was manufactured.

EXAMPLE 4

In the same way as in Example 1, except that a four-element-alloy having 0.5% by weight of cerium, 15.0% by weight of tungsten, 0.5% by weight of carbon and the remainder of iridium was manufactured using 0.5 g (grams) of cerium, 15.0 g of tungsten, 0.5 g of carbon and 84 g of iridium. Subsequently, using the four-element-alloy, an emitter was manufactured.

Comparative Example 1

After melting 5.0% by weight of cerium, 5.0% by weight of tungsten and the remainder of iridium in an argon-arc furnace and cooling, a trinary alloy was prepared.

Subsequently, using the trinary alloy, an emitter was manufactured.

Figure 2:
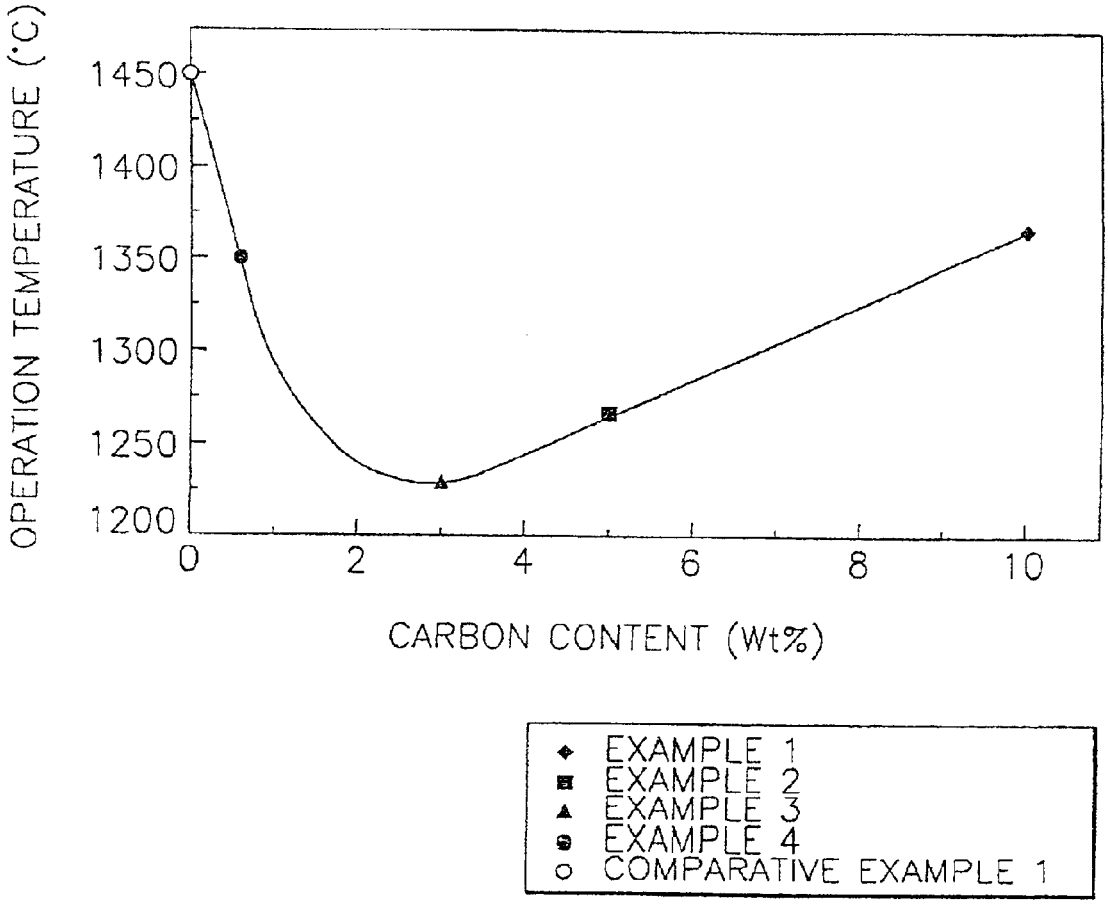
FIG. 2 is a graph of operation temperature as a function of the content of carbon in an emitter that is manufactured using the four-element-alloy of cerium, tungsten, carbon and iridium.

FIG. 2 shows the operation temperature and the current density emitted from the emitters manufactured according to Example 1–4 and Comparative example 1 put in an experimental vacuum tube of a vacuum glass cylinder equipped with an anode for receiving the electron emission current. Here, the temperature of the emitters was measured through the glass cylinder using an optical thermometer. The temperature when the emission current density is 5 A/cm$^2$ is considered as the operation temperature and a low operation temperature means that the work function is small.

Referring to FIG. 2, the operation temperature reaches 1450° C. (degrees Celsius) when the carbon content of the four-element-alloy of the present invention is 0% by weight (Comparative example 1), but it can be seen that as the carbon content increases (Examples 4 and 3), the operation temperature decreases rapidly. It is considered that this is due to the increase of the diffusion velocity of cerium to the alloy surface as the carbon content increases. Meanwhile, if the carbon content exceeds 3% by weight, the operation temperature begins to increase slowly (Examples 1–3), and if the carbon content exceeds 10% by weight, the operation temperature becomes more than 1350° C. and thus the lifetime of the emitter becomes shorter and shorter.

Figure 3:
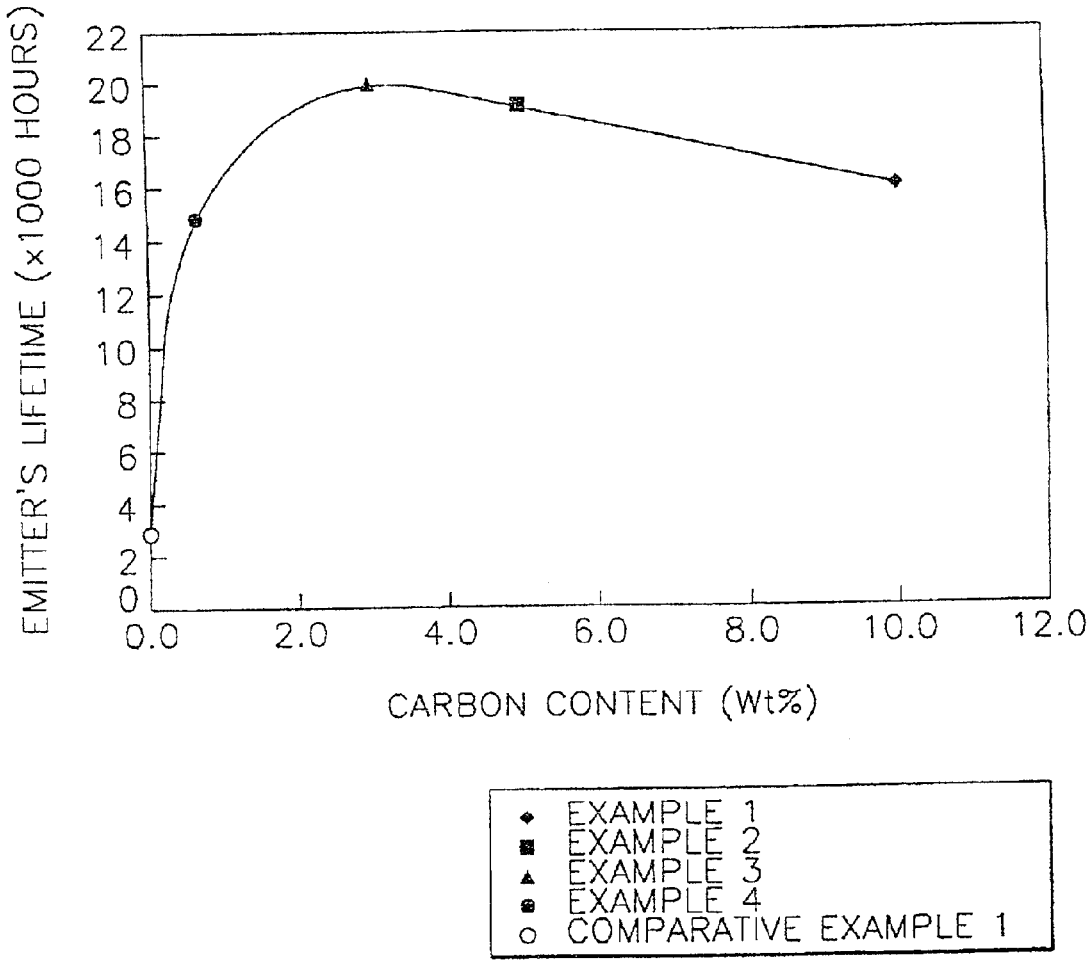
FIG. 3 is a graph of the lifetime of an emitter as a function of the content of carbon in the emitter that is manufactured using the four-element-alloy of cerium, tungsten, carbon and iridium.

The lifetime of an emitter at a specific temperature is determined by the evaporation speed of the rare earth metal of the cerium group from the electron emission material equipped in the emitter, and if the operation temperature of the emitter is low, the evaporation speed of the rare earth metal of the cerium group becomes low and thus the lifetime of the emitter becomes longer (Refer to FIG. 3). Therefore, it can be seen that when the same current density is emitted, the lifetime of the emitter equipped with the four-element-alloy (Ir—Ce—W—C) of the invention is longer than that of the trinary alloy (Ir—Ce—W).

The evaporation speed of the rare earth metal of the cerium group can be calculated with Formula 1 below and the lifetime of an emitter can be calculated with Formula 2 below. The lifetime of an emitter of size 0.6 mm×0.6 mm×0.2 mm, equipped with the four-element-alloy of the present invention is calculated to be 15000~20000 hours.

$$\gamma=\gamma_o\exp(-U_g/kT) \qquad \text{Formula 1}$$

Here in the above formula 1, γ is the evaporation rate of the cerium atom, $\gamma_o$ is the evaporation constant, $U_g$ is the activation energy of the rare earth metal of the cerium from the alloy surface, k is the Boltzmann constant, and T is the absolute temperature.

$$t=m/(\gamma s) \qquad \text{Formula 2}$$

In the above formula 2, t is the lifetime of the emitter, m is the mass of the rare earth metal of the cerium group in the emitter, γ is the evaporation rate of the cerium atom and s is the surface area of the emitter.

These values satisfy the values of the lifetime of the emitter required in electron beam apparatuses, especially the cathode-ray tube.

As seen above, the four-element-alloy of the invention has an excellent plasticity and a high electron emission power as well as it can be easily used for manufacturing an emitter. Moreover operation temperature of the four-element-alloy is low, giving it a long lifetime. For these reasons, the four-element-alloy is useful for a cathode material for an electron beam apparatus.

What is claimed is:

1. A cathode material for an electron beam apparatus, the cathode material consisting essentially of:

a rare earth metal of the cerium group comprising 0.5% to 9.0% of the total weight of the cathode material;

at least one element selected from the group consisting of tungsten and rhenium, comprising 0.5% to 15.0% of the total weight of the cathode material;

carbon comprising 0.5% to 10% of the total weight of the cathode material; and iridium.

2. The cathode material of claim 1, with the rare earth metal of the cerium group being at least one element selected from the group consisting of lanthanum, cerium, praseodymium, neodymium and samarium.

3. The cathode material of claim 2, with the carbon content being 2% to 5% by weight based on the total weight of the cathode material.

4. The cathode material of claim 2, with about 6% by weight of a rare earth metal of the cerium group, about 5% by weight of tungsten or rhenium or both tungsten and rhenium, and about 3% by weight of carbon, based on the total weight of the cathode material.

5. The cathode material of claim 1, with the carbon content being 2% to 5% by weight based on the total weight of the cathode material.

6. The cathode material of claim 1, with about 6% by weight of a rare earth metal of the cerium group, about 5% by weight of tungsten or rhenium or both tungsten and rhenium, and about 3% by weight of carbon, based on the total weight of the cathode material.

7. A cathode material for an electron beam apparatus, comprising:

a rare earth metal of the cerium group;

at least one element selected from the group consisting of tungsten and rhenium;

carbon of about 0.5% to about 10% of the total weight of the cathode material; and iridium.

8. The cathode material of claim 7, with the rare earth metal of the cerium group of about 0.5% to about 9.0% of the total weight of the cathode material.

9. The cathode material of claim 8, with the carbon content being about 2% to about 5% by weight based on the total weight of the cathode material.

10. The cathode material of claim 8, with at least one element selected from the group consisting of tungsten and rhenium comprising about 0.5% to about 15.0% of the total weight of the cathode material.

11. The cathode material of claim 10, with the carbon content being about 2% to about 5% by weight based on the total weight of the cathode material.

12. The cathode material of claim 7, with the carbon content being about 2% to about 5% by weight based on the total weight of the cathode material.

13. The cathode material of claim 12, with at least one element selected from the group consisting of tungsten and rhenium comprising about 0.5% to about 15.0% of the total weight of the cathode material.

14. The cathode material of claim 7, with at least one element selected from the group consisting of tungsten and rhenium comprising about 0.5% to about 15.0% of the total weight of the cathode material.

* * * * *